United States Patent [19]

Simonds

[11] Patent Number: 4,497,750

[45] Date of Patent: Feb. 5, 1985

[54] FUEL IMPACT DEVICE

[76] Inventor: Edward Simonds, 1505 E. Kenosha, Broken Arrow, Okla. 74012

[21] Appl. No.: 621,149

[22] Filed: Jun. 18, 1984

Related U.S. Application Data

[63] Continuation of Ser. No. 420,357, Sep. 17, 1982, abandoned.

[51] Int. Cl.[3] ..... F02M 17/16

[52] U.S. Cl. ..... 261/64 C; 261/89

[58] Field of Search ..... 261/87, 88, 89, 64 C

[56] References Cited

U.S. PATENT DOCUMENTS

| | | | |
|---|---|---|---|
| 1,040,885 | 10/1912 | Clark | 261/88 |
| 1,208,087 | 12/1916 | Browne | 261/64 C |
| 1,268,299 | 6/1918 | Thompson | 261/89 |
| 1,270,558 | 6/1918 | Scott | 261/64 C |
| 1,484,577 | 2/1924 | Skaer | 261/88 |
| 1,583,591 | 5/1926 | Greenawalt | 261/87 |
| 2,004,840 | 6/1935 | Suchtelen | 261/88 |
| 2,078,250 | 4/1937 | Hurlburt | 261/88 |
| 2,129,215 | 9/1938 | Howse et al. | 261/88 |
| 2,159,294 | 5/1939 | Schimanek | 261/64 C |
| 2,223,836 | 12/1940 | Snyder | 261/88 |
| 2,823,906 | 2/1958 | Gideon | 261/88 |
| 2,932,495 | 4/1960 | Olson | 261/89 |
| 3,066,921 | 12/1962 | Thommel et al. | 261/87 |
| 3,482,520 | 12/1969 | Larsen | 261/87 |
| 4,388,253 | 6/1983 | Maxwell | 261/88 |

*Primary Examiner*—Tim Miles

*Attorney, Agent, or Firm*—Head, Johnson & Stevenson

[57] ABSTRACT

An impact fuel system comprising an air chamber in communication with a fuel chamber, a rotatable fuel accelerator wheel interposed between the air chamber and fuel chamber, fuel passageway extending between a fuel supply and the central portion of the fuel accelerator wheel for directing fuel to the interior thereof, the fuel accelerator wheel being provided with outlet ports around the outer periphery thereof for ejecting fuel against an impact ring to break the fuel into small droplets, an air passageway provided around the outer periphery of the fuel accelerator wheel receives the air droplets at a void area in the air stream whereby highly vaporized fuel air mixture is delivered to an internal combustion engine or the like for fuel economy and reduction of pollutants in the exhaust gases of the engine.

7 Claims, 6 Drawing Figures

FUEL IMPACT DEVICE

This is a continuation of application Ser. No. 420,357, filed Sept. 17, 1982, now abandoned.

BACKGROUND OF THE INVENTION

1. Field of the Invention

This invention relates to improvements in carburetors, and more particularly, but not by way of limitation to a fuel impact device for increasing atomization of fuel prior to entry of the fuel into the manifold of an internal combustion engine.

2. Description of the Prior Art

In light of the present day energy shortage many attempts have been made to increase the efficiency of fuel consumption of an internal combustion engine or the like. It is widely acknowledged that atomization of the fuel prior to combustion thereof greatly increases the efficient use of the fuel in that a greater percentage of the fuel is ignited and burned in the combustion chamber. This not only provides more efficient use of the fuel but also greatly reduces the discharge of noxious elements into the atmosphere in reducing the exhaust gases of the engine. Many attempts to vaporize fuel have been made in the past such as those shown in the Boatright et al. U.S. Pat. No. 2,205,388 issue June 25, 1940 and entitled "Fuel Vaporizing Apparatus for Internal Combustion Engines"; The McCauley U.S. Pat. No. 3,952,716 issued Apr. 27, 1976 and entitled "Fuel Conservation Means for Internal Combustion Engines and the Like"; the Thomas, Jr. U.S. Pat. No. 3,955,548 issued May 11, 1976 and entitled "Fuel/Air Mixing Device for Internal Combustion Engine Carburetor"; the Knox, Sr. U.S. Pat. No. 4,011,850, issued Mar. 15, 1977 and entitled "Fuel Vaporizer for Internal Combustion Engines"; the McCauley U.S. Pat. No. 4,059,082, issued Nov. 22, 1977 and entitled "Fuel Conservation Means for Internal Combustion Engines and the Like"; the Kumm et al. U.S. Pat. No. 4,153,028 issued May 8, 1979 and entitled "Atomizer" and the Moore U.S. Pat. No. 4,153,653 issued May 9, 1979 and entitled "Fuel Induction System for Internal Combustion Engines".

These patents disclose various means for the vaporization of fuel and are generally concerned with heating of the fuel for vaporization thereof. In actual practice, however, none of the present day devices achieve anything close to a one hundred percent vaporization of the fuel and, of course, any improvement or increasing of the percentage of vaporization of the fuel can result in economy and environmental improvements.

The present invention contemplates a fuel impact device particularly designed and constructed for increasing the vaporization of fuel in an internal combustion engine and achieving such fuel vaporization in an economical and feasible manner. The novel device comprises a rotatable element having the fuel delivered essentially to the center thereof and discharged at the peripheral edge thereof as the device spins within a housing. The discharging fuel is impinged or impacted against the periphery of the housing surrounding the rotatable element and enters the air stream at a void area in the air stream. The void area in the air stream is created by an air foil configuration provided at the air stream outlet. The rotating element may be considered a fuel accelerator wheel and it is preferable to use low pressure fuel, maintaining the pressure at the outlet end of the fuel line at a relatively low pressure for maintaining a stream of fuel entering the fuel accelerator wheel instead of the injection of fuel droplets into the wheel, thus improving the efficient direction of the fluid from the peripheral port provided at the outer edge of the fuel wheel. In addition a spring urged door or accelerator gate means is provided responsive to the normal engine operation for directing the air stream into the fuel area in accordance with the engine's operational demands. The novel fuel impact device is simple and efficient in operation and economical and durable in construction.

DETAILED DESCRIPTION OF THE PREFERRED EMBODIMENT

Figure 1:
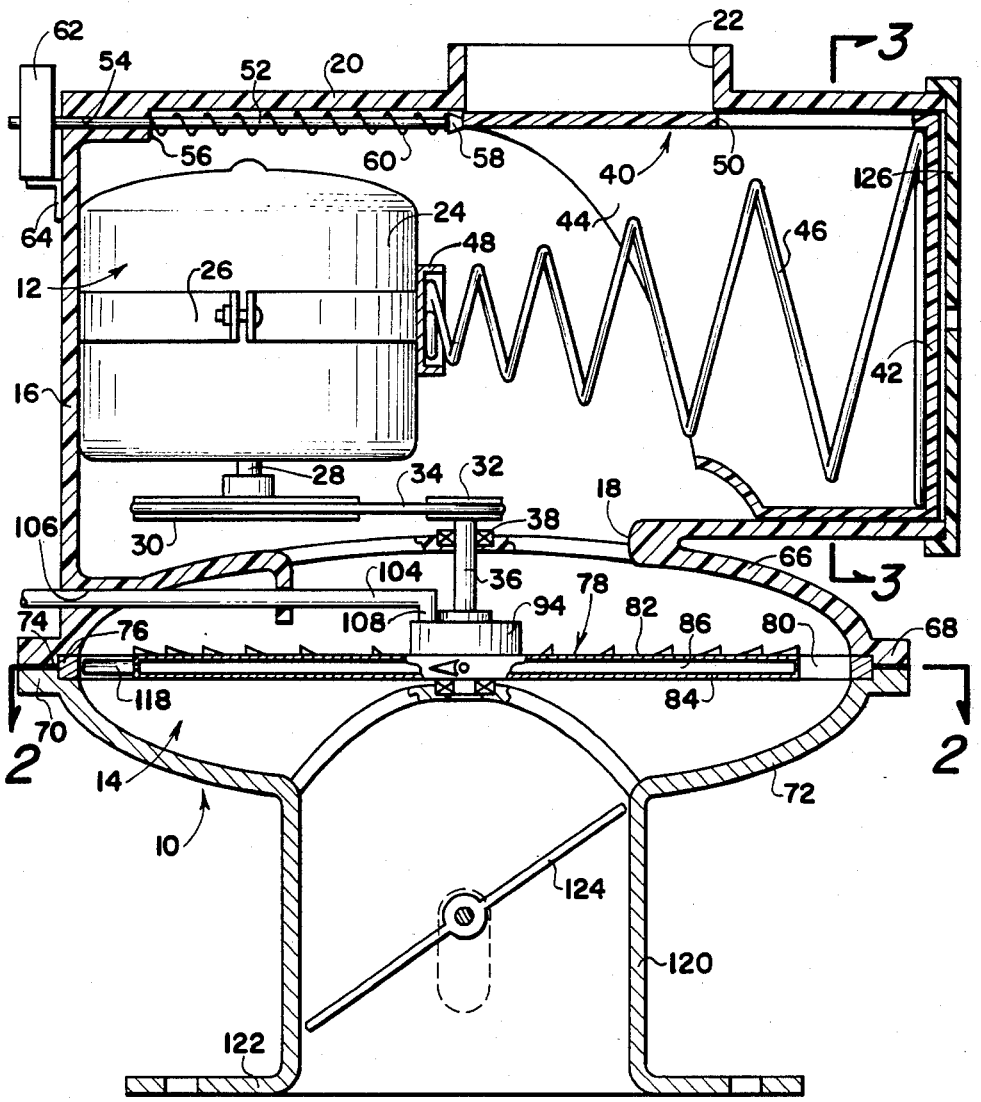
FIG. 1 is a sectional elevational view of a fuel impact device embodying the invention.

Referring to the drawings in detail, reference character 10 generally indicates a fuel impact device comprising an air intake chamber 12 and an air fuel mixture chamber 14 in open communication therewith. The air chamber comprises an outer housing 16 having a substantially central opening 18 provided therein for establishing the communication between the interior of the air chamber 12 and the air-fuel mixture chamber 14. The upper end of the air chamber 12 as viewed in the drawings is closed by a suitable cover plate 20 and an air inlet port 22 is provided therein for selectively admitting air into the interior of the air chamber 12 as will be hereinafter set forth. A suitable power source such as an electric motor 24 or the like is mounted in the interior of the chamber 12 in any suitable manner such as by a strap or bracket 26 and the drive shaft 28 of the motor is operably connected with a first pulley member 30 which in turn is in operable connection with a second pulley member 32 through a belt drive member 34 or the like whereby rotation may be transmitted to the pulley 32 upon activation of the motor 28. The pulley 32 is carried by a rotatable shaft 36 which extends through suitable bearing means 38 and into the fuel chamber 14 for a purpose as will be hereinafter set forth.

A cup member 40 is slidably disposed within the air chamber 12 and is provided with one closed end 42 and one open end 44. A helical spring 46 has one end suitable anchored on the inner surface of the closed end 42 and extends outwardly through the open end 44 whereby the opposite end of the spring 46 is suitably anchored in a cup or recess element 48 which may be secured to the outer periphery of the securing means 26. An opening or port 50 is provided in the sidewall of the cup 40 for selective alignment with the air inlet port 22 in order to admit air to the interior of the air chamber 12 during operation of the device 10. The spring 46 maintains the cup member 40 in a normal right hand position as viewed in FIG. 1 whereby the ports 50 and 22 are held out of alignment for precluding entry of air into the chamber 12.

A slidable stem member 52 extends through a port 54 provided in the sidewall of the chamber 12. A shoulder 56 is provided in the proximity of the inner end of the port 54 and a head member 58 is provided at the inner end of the stem means 52. A suitable helical spring 60 is disposed around the outer periphery of the stem 52 and interposed between the shoulder 56 and 58 for normally maintaining the head member 58 in engagement with the inner end of the cup member 40 as particularly shown in FIG. 1. The outer end of the stem 52 extends through the port 54 and therebeyond and an adjustment member 62 is threadedly or otherwise engaged at the outer end thereof exteriorly of the air chamber 12. It may be desirable to provide a support bracket means 64 on the outer periphery of the air chamber 12 for supporting the adjustment member 62. The adjustment member 62 may be selectively positioned on the stem 52 for regulating the distance through which the cup 40 may move in a left hand direction as viewed in FIG. 1 during operation of the device 10 as will be hereinafter set forth.

Figure 2:
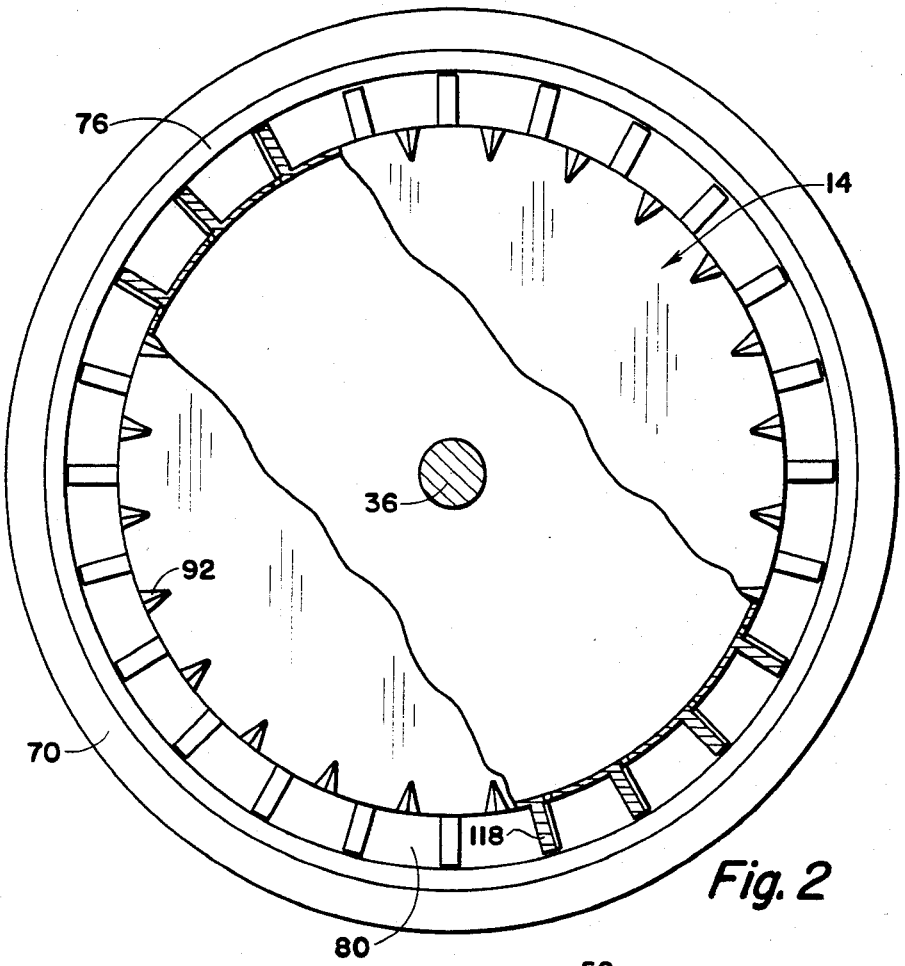
FIG. 2 is a view taken on line 2—2 of FIG. 1.
Figure 3:
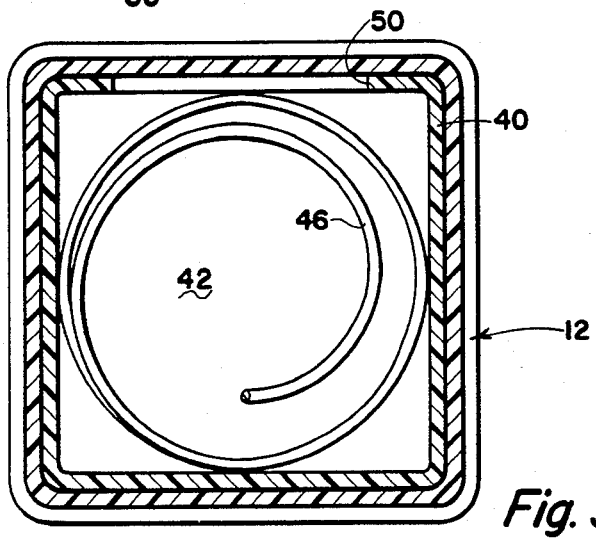
FIG. 3 is a view taken on line 3—3 of FIG. 1.
Figure 4:
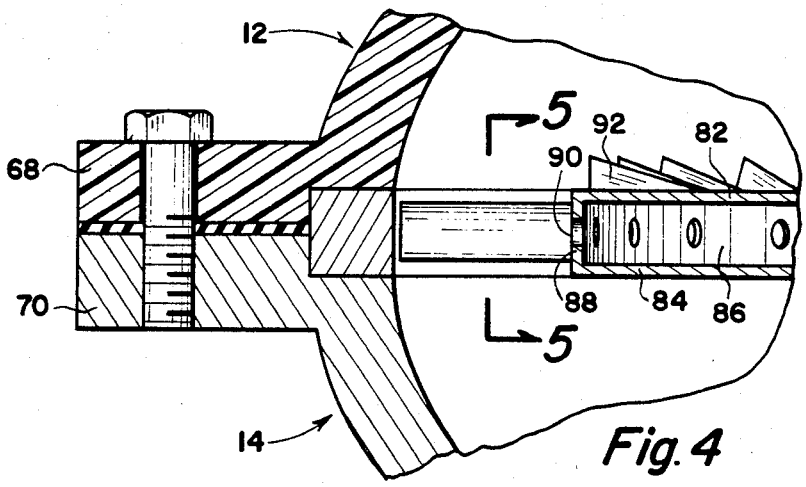
FIG. 4 is an enlarged sectional view of a portion of the outer periphery of the chamber and fuel accelerator wheel in a fuel impact device embodying the invention.

The lower portion of the air chamber 12 as viewed in FIG. 1 is provided with an arcuate configured housing portin 66 which terminates in an outwardly extending circumferential flange 68 which is adapted for engagement with an outwardly directed circumferential flange 70 provided around the outer periphery of an upper portion of a bowl member 72 of the fuel chamber 14. The flanges 68 and 70 may be secured together in any suitable means (not shown) and it is preferable to provide a seating gasket 74 therebetween for precluding leakage of fluid at the juncture between the air chamber 12 and air chamber 14. An annular insert means 76 is inserted at the juncture between the housings 72 and 66 and extends around the inner periphery thereof to provide an impact surface for fuel during the operation of the device 10. It is preferable that the ring or annular member 76 be constructed from a suitable hardened material for withstanding the force or pressure of a fluid impinging thereagainst. A fuel accelerator wheel 78 is mounted within the fuel chamber 14 in substantial alignment with the plane of the annular ring 76 and is of an outer diameter less than the inner diameter of the ring 76 providing a hiatus or air passage 80 therebetween. The fuel accelerator wheel 78 comprises a pair of substantially circular disc members 82 and 84 disposed in spaced substantially mutually parallel relationship providing a chamber 86 therebetween. The outer peripheral edges of the discs 82 and 84 are united or connected together by means of a cylindrical wall 88 (FIG. 4) and a plurality of circumferentially spaced ports 90 are provided throughout the circumference of the wall 88. The outer surface of the disc 82 is provided with a plurality of spaced ramp members 92, each ramp 92 being of a substantially triangular configuration in both the longitudinal and transverse directions as particularly shown in FIGS. 4 and 5. In addition, a centrally disposed port 94 is provided in the disc 82, the port comprising a substantially cylindrical sleeve extending axially outwardly from the outer surface of the disc 82 as will be seen particularly in FIGS. 1 and 2. A centrally disposed stub shaft member 96 extends from the inner surface of the disc 84 axially outwardly through the center of the sleeve 94 and is provided with an axially extending centrally disposed bore 98 for receiving the outer end of a rotatable shaft 36 therein. The cross sections of the bore 98 are preferably compatible whereby rotation of the shaft 36 is transmitted to the stub shaft 96 and thus to the disc 84 and 82. For example, the cross sectional configuration of the bore 98 and shaft 36 may be square thus readily transmitting rotation between the shaft 36 and stub shaft 96. Of course, the outer end of lower end of the stub shaft 96 is preferably provided with a reduced diameter stem 100 disposed in a suitable bearing means 102 supported in any suitable manner in the housing or fuel section 14.

Figure 6:
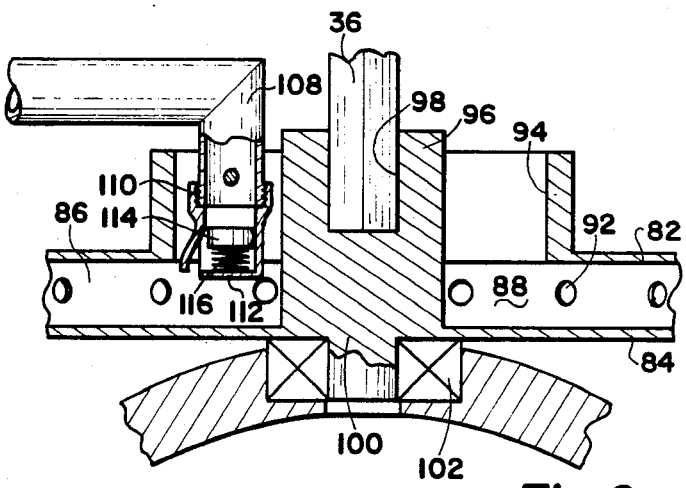
FIG. 6 is an enlarged sectional view of the central portion of the fuel accelerator wheel of a fuel impact device embodying the invention.

A fuel inlet conduit means 104 extends through a bore 106 (FIG. 1) provided in the sidewall of the air chamber 12 and preferably in the proximity of the outwardly extending flange member 68 but not limited thereto. The outer end (not shown) of the fuel inlet conduit is in communication with a source of fuel such as the fuel tank of the internal combustion engine (not shown) or the like with which the device 10 is to be utilized. The inner end of the fuel inlet conduit 104 is preferably bent or angled in a direction toward the interior of the sleeve 94 as shown at 108 in FIGS. 1 and 6. The outer end of the angled member 108 is preferably externally threaded as shown at 110 (FIG. 6) for receiving a fuel outlet valve means 112. The valve means 112 may be of any desired configuration and as shown herein includes a closure means 114 disposed in spaced relationship with respect to the angled member 108 and slidable in directions toward and away therefrom and responsive to the force of a suitable helical spring means for selectively admitting fuel from the conduit means 104–108 into the chamber 86 provided between the discs 82 and 84.

Figure 5:
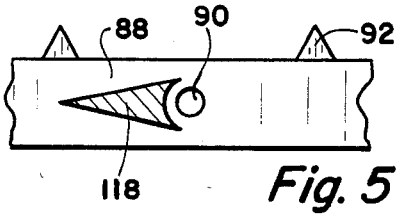
FIG. 5 is a view taken on line 5—5 of FIG. 4.

Referring now to FIG. 5 the outer periphery of the cylindrical wall 88 provided around the outer periphery of the discs 82 and 84 is provided with an air foil means 118 secured thereto in the proximity of each of the ports 90. This air foil creates a void area in the air stream moving through the passageway 80 during operation of the device 10 as will be hereinafter set forth.

Referring now to FIG. 1, the air-fuel bowl or chamber 14 is preferably supported by a suitable sleeve or neck means 120 and is open communication therewith for delivery of fluid thereto. The sleeve 120 is provided with an outwardly extending circumferential flange 122 at the outer end thereof for suitable connection in the proximity of the usual manifold (not shown) of an internal combustion engine or the like and is in open communication therewith for receiving operational pressures from the engine as is well known. A suitable throttle valve means 124 may be journalled in the interior of the neck 120 for controlling the flow of fluid therethrough in the usual and well known manner in response to the operating demands of the engine.

In operation, when the internal pressure of the air chamber 12 is sufficiently low that the pressure trapped between the closed ends 42 and the end 126 of the housing 12 exceeds the force of the spring 46 the cup 140 will be moved in a left hand direction as viewed in FIG. 1 moving the port 50 into alignment with the port 22. In this position air is pulled through the air inlet 22 and into the air chamber 12. The air is pulled around the outer periphery of the rotating fuel acceleration wheel and moves through the air passageway 80 therearound. At the same time, fuel being admitted into the chamber 86 is flung outwardly through the ports 82 and impinges against the inner periphery of the ring 76 with great force immediately in front of the air foil 118 carried on the outer periphery of the wheel 78 adjacent each of the ports. This air foil member 118 interrupts the air stream moving through the air passage 80 and creates a void at the point where the fuel enters the air stream. The fuel molecule lengthens into very small particles and enters the airstream at a void area creating a highly vaporized condition for the air fuel mixture moving into the neck 120 for delivery to the engine. It is preferable to maintain a low pressure for the fuel moving through the passageway 104 whereby the fuel entering the chamber 86 is at a constant stream as opposed to a series of droplets. This maintains an efficient fuel supply for the chamber 86 during operation of the device 10.

When internal operating conditions in the chamber 12 are such that the pressure therein is sufficient for cooperation with the spring 46 to move the cup member 40 in a right hand direction to the position shown in FIG. 1, the flow of air through the air inlet 22 is precluded. At this time it is desirable to cease the flow of fuel to the chamber 86 and interrupt the operation of the device 10.

From the foregoing it will be apparent that the present invention provides a novel impact fuel device for delivery of a substantially vaporized fuel in an air fuel mixture to an internal combustion engine or the like. The novel device includes a fuel accelerator wheel which ejects fuel radially outwardly for impacting or impinging against an impact ring for breaking the fuel into small particles and the fuel wheel is provided with air foil means interrupting the air flow whereby the fuel is directed into the air stream at a void area in the air flow system. This provides an economy of operation for the internal combustion engine in that great fuel efficiency is achieved.

Whereas the present invention has been described in particular relation to the drawings attached hereto it should be understood that other and further modifications apart from those shown or suggested herein may be made within the spirit and scope of this invention.

What is claimed is:

1. A fuel impact device for an internal combustion engine comprising air chamber means, air-fuel mixture chamber means in open communication with the air chamber means of the internal combustion engine, air valve means provided in the air chamber means for selectively admitting air into the interior thereof, rotatable fuel accelerator means journalled between the air chamber means and air-fuel mixture chamber means, internal fuel receiving chamber means provided in the fuel accelerator means, impact ring means disposed around the fuel accelerator means and concentrically arranged with respect thereto to provide an air passageway therebetween, fuel inlet means provided in the fuel accelerator means and in intimate communication with the fuel receiving chamber means for delivery of the fuel directly thereto, fuel discharge means provided around the outer periphery of the fuel accelerator means for radially outward discharge of the fuel from the fuel receiving chamber means for impinging fuel against the impact ring means, air foil means on the fuel accelerator means extending into the air passageway for providing a void area in the air moving therethrough at the point wherein the fuel is discharged, and the air valve means comprises housing means slidably disposed within the air chamber means and having port means providing open and closed positions for the air valve for controlling the quantity of air admitted into the air chamber upon reciprocation of the housing means within the air chamber, the housing means having one end open for receiving a helical spring means therein and one end closed for engagement by the helical spring means for constantly urging the housing means toward the closed position therefor, the helical spring means being responsive to the demand of the internal combustion engine for reciprocation the housing means within the air chamber for admitting the optimum quantity of air into the air chamber in accordance with the engine demand.

2. A fuel impact device as set forth in claim 1 wherein power means is operably connected with the fuel accelerator means for selectively transmitting rotation thereto.

3. A fuel impact device as set forth in claim 1 wherein the fuel accelerator means comprises a pair of spaced substantially mutually parallel disc members having the fuel receiving chamber means therebetween, the outer peripheries thereof being connected together by a cylindrical wall, said fuel discharge means comprising a plurality of spaced ports provided in the cylindrical wall for the radially outward discharge of the fuel from the fuel receiving chamber means.

4. A fuel impact device as set forth in claim 3 wherein the fuel inlet means comprises fuel passageway means in intimate communication with the fuel receiving chamber means in the fuel accelerator wheel.

5. A fuel impact device as set forth in claim 4 wherein the fuel passageway means is in intimate communication with the central portion of the fuel receiving chamber means.

6. A fuel impact device as set forth in claim 3 and including radially outwardly extending air foil means secured to the outer periphery of the cylindrical wall and projecting into the air passageway for producing a void area in the air moving through the air passageway.

7. A fuel impact device as set forth in claim 6 wherein the air foil means comprises a radially outwardly extending air foil member disposed in the proximity of each of the ports provided in the cylindrical wall.

* * * * *